US009466865B2

(12) United States Patent
Kroening

(10) Patent No.: US 9,466,865 B2
(45) Date of Patent: Oct. 11, 2016

(54) SYSTEMS AND METHODS FOR IMPROVED FERRITE CIRCULATOR RF POWER HANDLING

(71) Applicant: Honeywell International Inc., Morristown, NJ (US)

(72) Inventor: Adam M. Kroening, Atlanta, GA (US)

(73) Assignee: Honeywell International Inc., Morris Plains, NJ (US)

( * ) Notice: Subject to any disclaimer, the term of this patent is extended or adjusted under 35 U.S.C. 154(b) by 203 days.

(21) Appl. No.: 14/247,454

(22) Filed: Apr. 8, 2014

(65) Prior Publication Data

US 2015/0288046 A1 Oct. 8, 2015

(51) Int. Cl.

| | |
|---|---|
| ***H01P 1/38*** | (2006.01) |
| ***H01P 1/11*** | (2006.01) |
| ***H01P 1/39*** | (2006.01) |
| *H01P 1/22* | (2006.01) |
| *H01P 1/26* | (2006.01) |

(52) U.S. Cl.
CPC . *H01P 1/38* (2013.01); *H01P 1/11* (2013.01); *H01P 1/39* (2013.01); *H01P 1/222* (2013.01); *H01P 1/262* (2013.01)

(58) Field of Classification Search
CPC ..... H01P 1/32; H01P 1/36; H01P 1/38
USPC ..... 333/1.1, 24.2; 455/78
See application file for complete search history.

(56) References Cited

U.S. PATENT DOCUMENTS

| | | | |
|---|---|---|---|
| 2,702,371 | A | 2/1955 | Sunstein |
| 3,624,556 | A | 11/1971 | Perreault |
| 4,039,947 | A | 8/1977 | Miedema |
| 4,837,580 | A | 6/1989 | Frazita |
| 5,097,233 | A | 3/1992 | Pekarek |
| 5,815,803 | A | 9/1998 | Ho et al. |
| 6,108,313 | A | 8/2000 | Lee et al. |
| 6,335,665 | B1 | 1/2002 | Mendelsohn |
| 6,885,257 | B2 | 4/2005 | Kroening |
| 7,561,003 | B2 | 7/2009 | Kroening |
| 7,683,731 | B2 | 3/2010 | Kroening |
| 7,816,995 | B1 | 10/2010 | Allen et al. |
| 2003/0107447 | A1 | 6/2003 | Kroening |
| 2005/0030117 | A1 | 2/2005 | Kroening |

(Continued)

FOREIGN PATENT DOCUMENTS

| | | |
|---|---|---|
| JP | 6083402 | 5/1985 |

OTHER PUBLICATIONS

U.S. Patent and Trademark Office, "Restriction Requirement", "from U.S. Appl. No. 14/247,452", Feb. 5, 2016, pp. 1-8, Published in: US.

(Continued)

*Primary Examiner* — Stephen E Jones
(74) *Attorney, Agent, or Firm* — Fogg & Powers LLC

(57) ABSTRACT

Systems and methods for improved ferrite circulator RF power handling are provided. In one embodiment, a high power circulator switch comprises: at least three ferrite circulators, the at least three ferrite circulators arranged as a triad switch, wherein a first circulator is coupled to a first output of the triad switch, a second circulator is coupled to a second output of the triad switch, and a third circulator is coupled to an input of the triad switch; and a shared high power load having a first port coupled to the first circulator and a second port coupled to the second circulator.

20 Claims, 4 Drawing Sheets

(56) References Cited

U.S. PATENT DOCUMENTS

| | | | | |
|---|---|---|---|---|
| 2013/0271232 | A1 | 10/2013 | Rose et al. | |
| 2014/0049335 | A1 | 2/2014 | Kroening | |
| 2015/0180109 | A1* | 6/2015 | Kroening | H01P 1/181 333/164 |
| 2015/0288047 | A1 | 10/2015 | Kroening | |

OTHER PUBLICATIONS

Alcivar, "Seminar Subjects: An Elementary Introduction to Ferrite Isolators, Circulators and RF Loads", 1992, pp. 1-14, Publisher: TX RX Systems Inc.

"Magic tees", "retrieved Apr. 7, 2014 from Internet http://www.microwaves101.com/encyclopedia/magictee.cfm", Mar. 17, 2008, pp. 1-5.

"Branchline couplers", "retrieved Apr. 7, 2014 from Internet http://www.microwaves101.com/encyclopedia/Branchline_couplers.cfm", May 11, 2011.

"Radar Basics", "Retrieved Mar. 14, 2014 from http://www.radartutorial.eu/17.bauteile/bt33.en.html", , p. 1.

Kroening, "Circulator With Ferrite Element Attached to Waveguide Sidewalls", "U.S. Appl. No. 13/949,668, filed Jul. 24, 2013", Jul. 24, 2013, pp. 1-31.

Wang et al., "Design and Construction of a 7MW High Power Circulator", "Proceedings of the Second Asian Particle Accelerator Conference", 2001, pp. 763-765, Published in: CN.

Williams et al., "Communications Satellite Antennas With On-Orbit Pattern Flexibility", "Microwave Journal", Aug. 2004, pp. 1-8, Publisher: Horizon House Publications, Inc.

European Patent Office, "Extended European Search Report from EP Application No. 15160667.0 mailed Aug. 3, 2015", "from Foreign Counterpart of U.S. Appl. No. 14/247,452", Aug. 3, 2015, pp. 1-10, Published in: EP.

European Patent Office, "Extended European Search Report from EP Application No. 15160673.8 mailed Aug. 3, 2015", "from Foreign Counterpart of U.S. Appl. No. 14/247,454", Aug. 3, 2015, pp. 1-9, Published in: EP.

Kroening, "Systems and Methods for Using Power Dividers for Improved Ferrite Circulator RF Power Handling", "U.S. Appl. No. 14/247,452, filed Apr. 8, 2014", Apr. 8, 2014, pp. 1-23, Published in: US.

U.S. Patent and Trademark Office, Notice of Allowance, from U.S. Appl. No. 14/247,452, May 18, 2016, pp. 1-30, Published in: US.

European Patent Office, Communication Under Rule 71(3) from EP Application No. 15160673.8 mailed Apr. 29, 2016, From Foreign Counterpart of U.S Appl. No. 14/247,454, Apr. 29, 2016, pp. 126, Published in: EP.

* cited by examiner

SYSTEMS AND METHODS FOR IMPROVED FERRITE CIRCULATOR RF POWER HANDLING

CROSS-REFERENCE TO RELATED APPLICATIONS

This Application is related to U.S. patent application Ser. No. 14/247,452 entitled, "SYSTEMS AND METHODS FOR USING POWER DIVIDERS FOR IMPROVED FERRITE CIRCULATOR RF POWER HANDLING", filed on even date herewith, which is incorporated herein by reference in its entirety.

BACKGROUND

Ferrite switching circulators can be used to implement downlink beam hopping techniques in multibeam broadband satellite systems, where a single high power RF input can be quickly switched to multiple output antennas. A single 3-port ferrite circulator switch, although simple to implement, compact and relatively inexpensive, has a downside in that if a short or open circuit occurs within a connected output port, or if an output port is not properly connected, then radio frequency (RF) power can be reflected back into the switch. This reflected power can travel back through the circulator, exit another port of the circulator, and energize equipment that should have remained de-energized. To provide isolation between switched output ports, designs have been introduced comprising a configuration of three multifunction waveguide ferrite circulators (sometimes referred to as a ferrite circulator "triad") which include three ferrite junction switches and two high power loads. In a triad design, one of two high power loads is coupled to a first circulator while the other high power load is coupled to a second circulator. The input to a third ferrite circulator is switched between two outputs, where the first output is coupled to the input of the first ferrite circulator, and the third circulator's second output is coupled to the input of the second circulator. In such a triad design, if a short circuit occurs on a connection to the output port of the first ferrite circulator, then the reflected RF power is reflected back into the circulator and directed to its high power load which serves to absorb the reflected RF power. Similarly, the high power load coupled to the second circulator will receive and absorb reflected RF power received back in from the output port of the second circulator. Since minimal reflected RF power is transmitted back to the third circulator, isolation between the two output ports of the triad is achieved.

In order to improve satellite throughput in satellite communications, specified RF power levels used by satellites have been on the rise. The increases in RF power level may come either through improvements in output power of the on-board high power transmitters or through the combining of several high power transmitters. For this increase in RF power level, the limitation in the triad switches is the power handling of the ferrite switches and high power loads. That is, the high power loads used by the triad switches need to be able to handle the full transmit power levels (which can be on the order of 50 to 500 watts, for example) in case of a short circuit at an output to the switch. The high power loads need to be capable of absorbing the full reflected input power, which typically translates into the need for the high power loads to be larger and heavier. In the design of satellite systems, however, the space available within the satellite is typically a premium resource, and any extra weight has a direct detrimental effect in the cost associated with launching the satellite into orbit.

For the reasons stated above and for other reasons stated below which will become apparent to those skilled in the art upon reading and understanding the specification, there is a need in the art for improved systems and methods for improved ferrite circulator RF power handling.

SUMMARY

The Embodiments of the present invention provide methods and systems for improved ferrite circulator RF power handling and will be understood by reading and studying the following specification.

Systems and methods for improved ferrite circulator RF power handling are provided. In one embodiment, a high power circulator switch comprises: at least three ferrite circulators, the at least three ferrite circulators arranged as a triad switch, wherein a first circulator is coupled to a first output of the triad switch, a second circulator is coupled to a second output of the triad switch, and a third circulator is coupled to an input of the triad switch; and a shared high power load having a first port coupled to the first circulator and a second port coupled to the second circulator.

DRAWINGS

Embodiments of the present invention can be more easily understood and further advantages and uses thereof more readily apparent, when considered in view of the description of the preferred embodiments and the following figures in which.

In accordance with common practice, the various described features are not drawn to scale but are drawn to emphasize features relevant to the present invention. Reference characters denote like elements throughout figures and text.

DETAILED DESCRIPTION

In the following detailed description, reference is made to the accompanying drawings that form a part hereof, and in which is shown by way of specific illustrative embodiments in which the invention may be practiced. These embodiments are described in sufficient detail to enable those skilled in the art to practice the invention, and it is to be understood that other embodiments may be utilized and that logical, mechanical and electrical changes may be made without departing from the scope of the present invention. The following detailed description is, therefore, not to be taken in a limiting sense.

Embodiments of the present invention address the needs of triad circulator junction switches to be able to absorb the full reflected input power through new switch designs. As explained below, a triad ferrite circulator switch couples input devices exclusively to one of two outputs. Embodiments of the present disclosure take advantage of the fact that only one high power load is truly required for triad switch operation.

Figure 1:
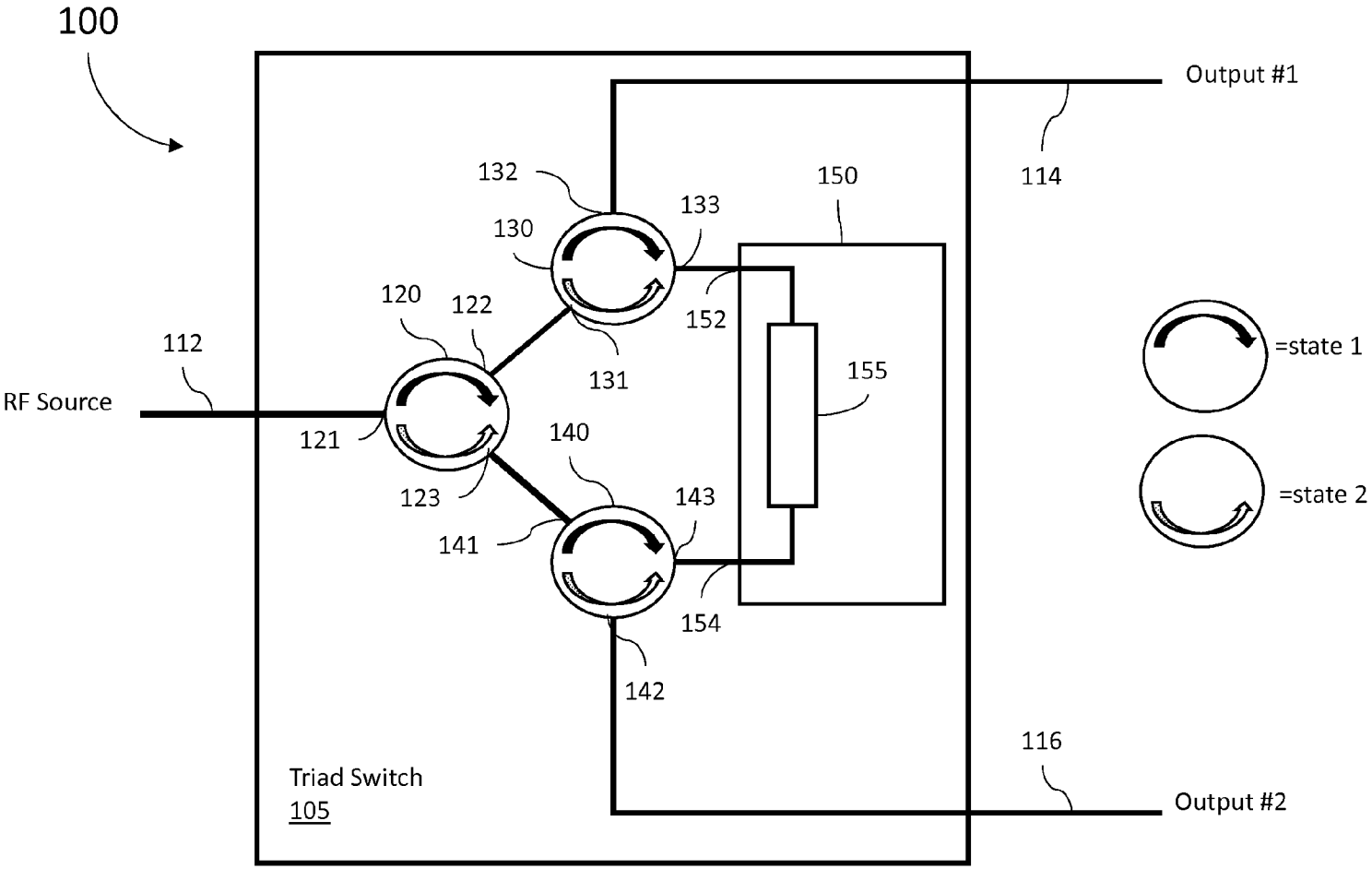
FIG. 1 is a block diagram illustrating a triad ferrite circulator switch of one embodiment of the present invention.

FIG. 1 is a diagram generally at 100 illustrating a triad ferrite circulator switch 105 (also referred to herein simply as "triad switch" 105) of one embodiment of the present disclosure. Triad switch 105 includes an input port 112 and two output ports 114 and 116. Triad switch 105 functions as a switchable waveguide, receiving an RF energy wave at point 112 and switching the wave to either ports 114 or 116. This switching is achieved while maintaining a high degree of isolation (e.g. >30 dB) between ports 114 and 116. In the embodiment shown in FIG. 1, triad switch 105 comprises a triad of ferrite circulators 120, 130 and 140. Input port 112 is coupled to an input 121 of a ferrite circulator 120 which is switched between two outputs 122 and 123. The circulator 120 output 122 is coupled to the input 131 of ferrite circulator 130, while the circulator 120 output 123 is coupled to the input 141 of ferrite circulator 140. Port 132 of ferrite circulator 130 serves as the first output port 114 of triad switch 105 while port 142 of ferrite circulator 140 serves as the second output port 116 of triad switch 105. In this disclosure, the ferrite circulator 130 coupled to first output port 114 may be referred to as the "first circulator 130", the ferrite circulator 140 coupled to second output port 116 may be referred to as the "second circulator 140", and the ferrite circulator 120 coupled to the input port 112 may be referred to as the "third circulator 120."

In order to dissipate any reflected RF power received back into output ports 114 and 116, triad switch 105 further comprises a shared high power load 150 which in this embodiment comprises a two port attenuating wave guide 155. That is, the shared high power load 150 comprises a first port 152 coupled to port 133 of circulator 130 and a second port 154 coupled to port 143 of circulator 140. The two port attenuating wave guide 155 may therefore be thought of as common to or shared by the two circulators 130 and 140. Because shared high power load 150 needs to be well-matched to the load connected to circulator outputs 133 and 143 (for example, the return loss of load 150 should be greater than 15 dB) and because it needs to be a 2 port device with high attenuation (for example, having greater than 30 dB attenuation or through loss from port 152 to port 154 and vise-verse) it may also be considered as an attenuator or attenuator load.

Triad switch 105 has only two operating states. In state 1, port 114 is "on" (i.e. port 114 is coupled to, and receives RF energy from, input port 112) while port 116 is "off" (i.e., isolated from both the input port 112 and output port 114). In state 2, port 116 is "on" (i.e. port 116 is coupled to, and receives RF energy from, input port 112) while port 114 is "off" (i.e., isolated from both the input port 112 and output port 116).

Circulator 120 comprises a ferrite circulator waveguide that comprise the input port 121, and the first and second output ports 122, 123. Depending on the selected state of triad switch 105, the direction of circulation within circulator 120 is either clockwise (CW) or counter-clockwise (CCW), and an RF energy wave entering input port 121 flows either to the output port 122 or the output port 123. For example, in the embodiment shown in FIG. 1, when triad switch 105 is in the first state, circulator 120 directs energy through the circulator in a first direction to its first output port 122 and out to the first circulator 130. When triad switch 105 is in the second state, circulator 120 directs energy through the circulator in a second direction to its second output port 123 and out to the second circulator 140. Circulators 130 and 140 each also comprises ferrite circulator waveguides which include input ports 131 and 141, respectively. Circulator 130 includes an output port 132 that serves as the first output port 114 of triad switch 105, while circulator 140 includes an output port 142 that serves as the second output port 116 of triad switch 105.

In one embodiment, this two-state operation is achieved by switching circulator 120 while circulators 130 and 140 are maintained in a fixed state. That is, when circulator 120 is switched to provide an output to circulator 130, the RF energy is sent to output port 132 and first output port 114 of triad switch 105. Any reflected RF power received back into port 114 will enter into circulator 130 and travel around the circulator in the first direction to port 152 of shared high power load 150. When circulator 120 is switched to provide an output to circulator 140, the RF energy is sent to output port 142 and second output port 116 of triad switch 105. Any reflected RF power received back into port 116 will enter into circulator 140 and travel around the circulator in the second direction to port 154 of shared high power load 150.

In other embodiments, this two-state operation is achieved by the coordinated switching of the three circulators 120, 130 and 140. In that case, when triad switch 105 is in the first state, circulator 130 is switched "on" so that RF energy entering input port 131 flows through the circulator in the first direction and then out through port 114. While triad switch 105 is in this first state, any reflected RF power received back into port 114 will enter into circulator 130 and travel around the circulator in the first direction to the first port 152 of shared high power load 150. When triad switch 105 is in the second state, circulator 130 is switched "off" Any energy entering input port 131 (which should be negligible since circulator 120 is switched to circulator 140 in this first state) flows around the circulator in a second direction (opposite direction to the first direction) to port 133 and is absorbed by shared high power load 150. When triad switch 105 is in the second state, circulator 140 is switched "on", so that RF energy entering input port 141 flows through the circulator in the second direction and then out through port 116. While triad switch 105 is in this second state, any reflected RF power received back into port 116 will enter into circulator 140 and travel around the circulator in the second direction to the second port 154 of shared high power load 150. When triad switch 105 is in the first state, circulator 140 is switched "off" Any energy entering input port 141 (which should be negligible since circulator 120 is switched to circulator 130 in this second state) flows around the circulator in the first direction (opposite direction to the second direction) to port 143 and is absorbed by shared high power load 150. As such, in this embodiment, the triad of switching circulators 120, 130 and 140 are always switched in lock-step as a group.

In other of these embodiments, at any one instance in time, one, and only one, of the outputs 114 or 116 is ever switched to the "on" state. Similarly, at any one instance in time, circulator 120 is switched to provide RF energy to only one of the circulators 130, 140. In this way, triad switch 105 routes high power to only a single output at a time and the shared high power load 150 will need to absorb high power RF reflections from only a single output port at a time. Thus, the shared high power load will only ever need to absorb reflected power (for example, from a short circuit) from only one of the two outputs (114 or 116) at any one time. For this reason, the shared high power load 150 only needs to be rated to absorb the maximum possible reflected RF power from either output. Further, because shared high power load 150 is a shared load, for both output ports 114 and 116, the need for separate loads for absorbing reflected RF power for each of the outputs 114 and 116 is avoided, saving space, weight and expense.

As mentioned above, in the embodiment shown in FIG. 1, one option for implementing the shared high power load 150 is by using a two port attenuating wave guide 155 which functions as a double ended load that can absorb an RF energy wave that enters through either end. In one embodiment, the two port attenuating wave guide 155 comprises a tapered wedge design of absorbent material that substantially absorbs and spreads out the energy from reflected RF power along the length of the waveguide. In this way, the reflected RF power entering one side of the waveguide is essentially completely attenuated to a negligible power level before reaching the second side of the waveguide. In some embodiments, the two port attenuating wave guide 155 may comprise staggered waveguide paths so a portion of the waveguide used from each side is shared by the two ports, and a portion is not shared.

Figure 2:
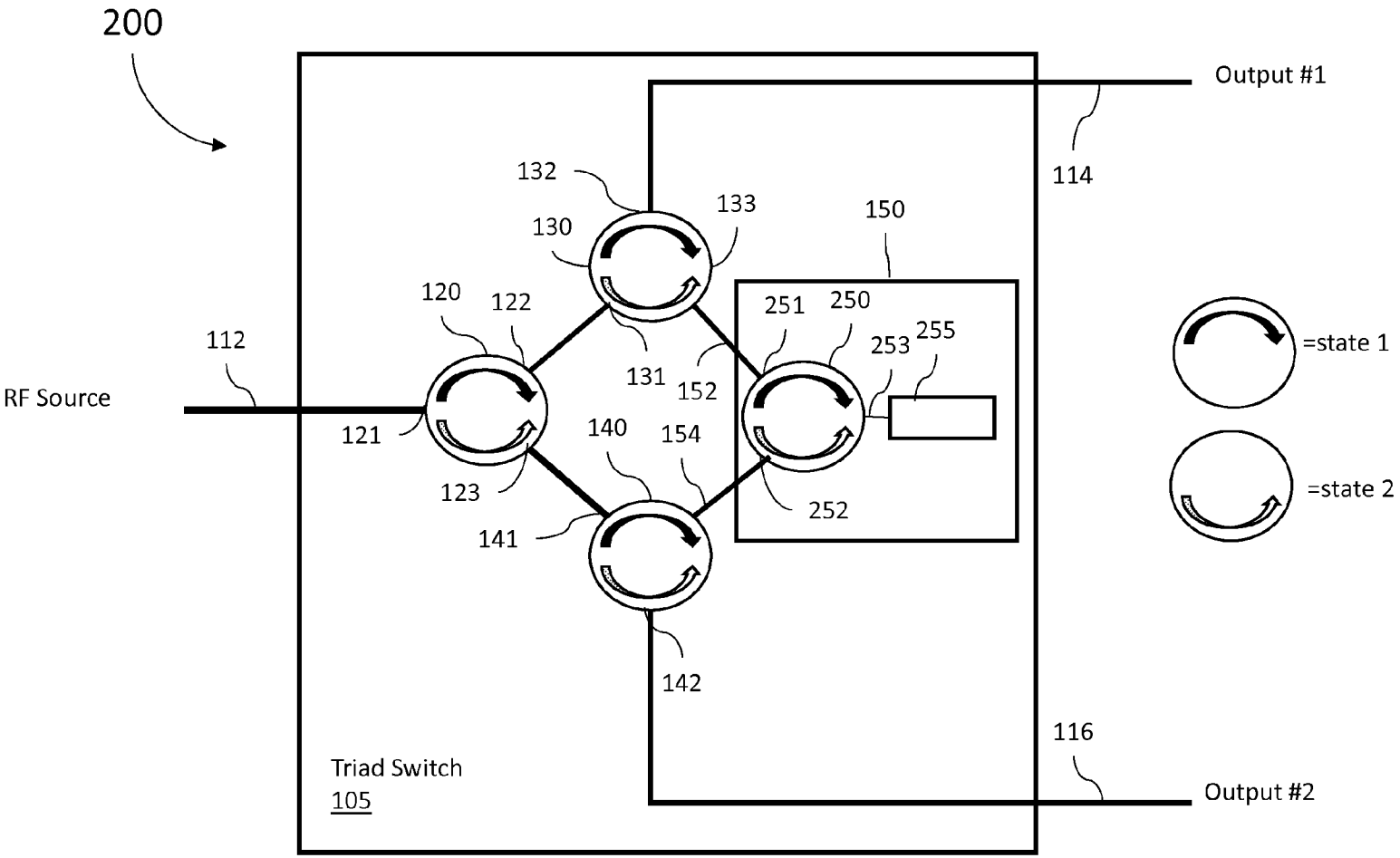
FIG. 2 is a block diagram illustrating a triad ferrite circulator switch of one embodiment of the present invention.

In the embodiment shown in FIG. 2, shared high power load 150 is instead implemented using an additional circulator 250 coupled to a high power load 255. In this configuration, the state of circulator 250 is also switched in lock-step at least with circulator 120 such that reflected RF power received at circulator 250 is always directed to high power load 255. More specifically, when triad switch 105 is switched to its first state to direct RF power from input 112 to output 114, any reflected RF power will be directed to port 152 of shared high power load 150 as described above. In this embodiment, reflected RF power directed to port 152 enters a first port 251 of circulator 250, which in this switching state directs that power out port 253 and into high power load 255 where it will be absorbed. Conversely, when triad switch 105 is switched to its second state to direct RF power from input 112 to output 116, any reflected RF power will be directed to port 154 of shared high power load 150. In this embodiment, reflected RF power directed to port 154 enters port 252 of circulator 250, which in this switching state now directs that power out to port 253 and into high power load 255 where it will be absorbed.

It should be appreciated that additional embodiments include multiple instances of triad switches such as switch 105 coupled together in various combinations to achieve different switching configurations. That is, the input port 112 of a triad switch may itself be coupled to a switched source of RF power. For example, input port 112 may be connected to the output port of an upstream circulator, or even to the output port of a prior upstream triad switch (which may, or may not, be a triad switch having a configuration such as shown with respect to triad switch 105). In this way, a 1×4 switch configuration may be obtained, as an example, by coupling the respective input ports 112 of two instances of triad switch 105 to respective outputs of an upstream switching device which is coupled to the RF source.

Figure 3:
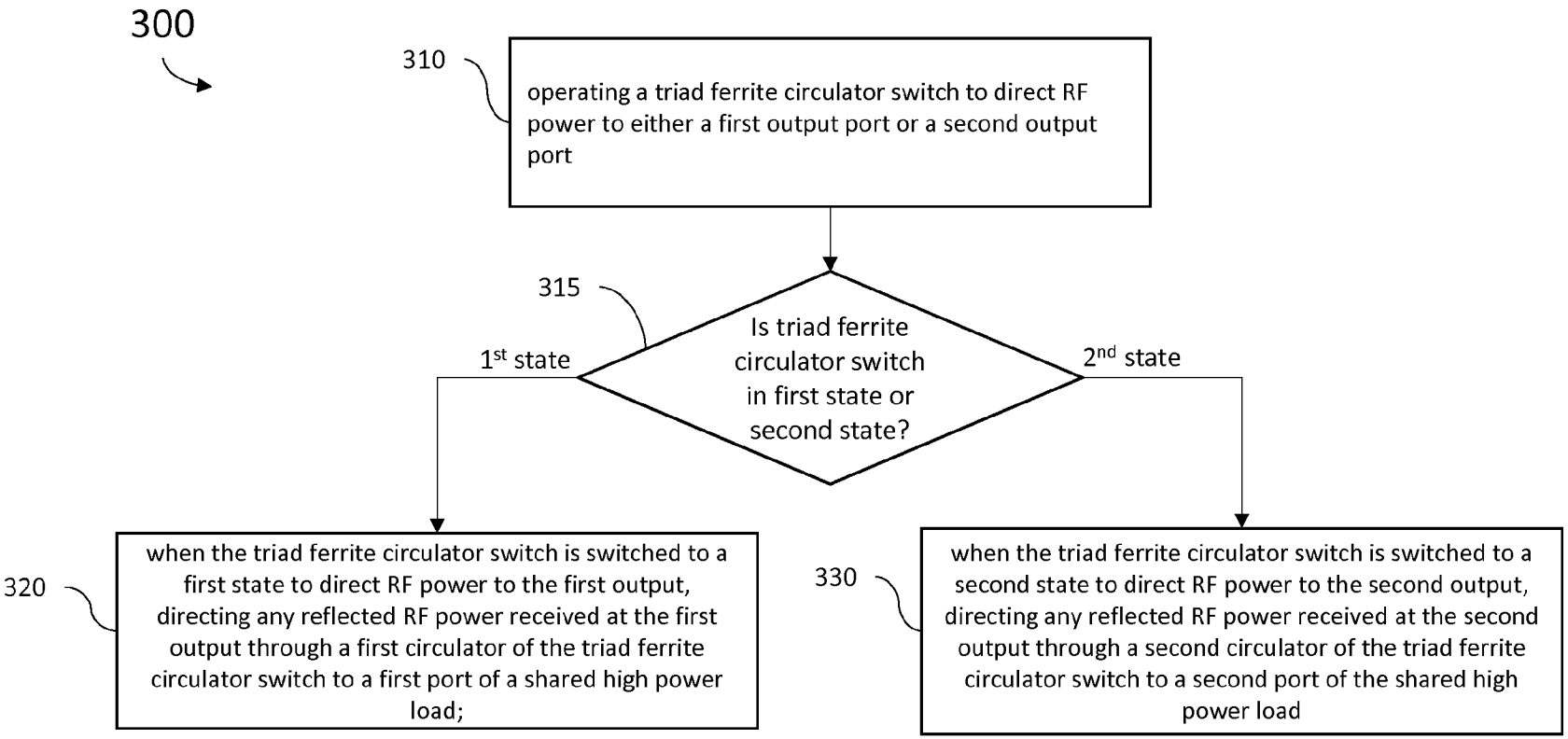
FIG. 3 is a flow chart illustrating a method of one embodiment of the present disclosure.

FIG. 3 is a flow chart illustrating a method 300 of one embodiment of the present invention. In some embodiments, the method 300 may be implemented using any of the various embodiments and implementations discussed above with respect to triad switch 150. In other embodiments, other variations on triad switch 150 may be utilized.

Method 300 begins at 310 with operating a triad ferrite circulator switch to direct RF power to either a first output port or a second output port. As mentioned above, a triad ferrite circulator switch comprises a triad of ferrite circulators, such as discussed above.

When the triad ferrite circulator switch is switched to a first state to direct RF power to the first output (checked at 315), the method proceeds to 320 with directing any reflected RF power received at the first output through a first circulator of the triad ferrite circulator switch to a first port of a shared high power load.

When the triad ferrite circulator switch is switched to a second state to direct RF power to the second output (checked at 315), the method proceeds to 330 with directing any reflected RF power received at the second output through a second circulator of the triad ferrite circulator switch to a second port of the shared high power load.

In this embodiment, the first ferrite circulator is coupled to the first output port, and the second ferrite circulator is coupled to the second output port. Further, a third circulator may be coupled to the input of the switch. The third circulator directs RF power it receives at the input of the switch to the first ferrite circulator when the switch is operating in the first state. When the switch is operating in the second state, the third circulator instead directs RF power it receives at the input of the switch to the second ferrite circulator. In the first state, the first circulator is configured to receive the RF power from the third circulator and send it to the first output port of the switch. While in this state, the first circulator will also direct any reflected RF power it receives at the first output port to the shared high power load, where it will be absorbed as described in any of the above embodiments. In the second state, the second circulator is configured to receive the RF power from the third circulator and send it to the second output port of the switch. While in this state, the second circulator will also direct any reflected RF power it receives at the second output port to the shared high power load, where it will be absorbed as described in any of the above embodiments. In some embodiments, the first and second circulators (i.e., those connected to the first and second output of the triad ferrite circulator switch, are fixed to always direct RF power received from the third circulator to the outputs of the triad ferrite circulator switch. In other embodiments, the first, second and third circulators are each controlled in a lock-step manner such that the triad ferrite circulator switch is operated in either a first state or a second state as described above.

For some implementations, the shared high power load utilized in method 300 may comprise a two port attenuating wave guide, such as the double ended waveguide 155 discussed above. In other embodiments, the shared high power load may comprise the combination of a fourth ferrite circulator coupled to a high power load, such as illustrated in FIG. 2. In this configuration, the state of the fourth circulator (which may also be referred to as the "shared load circulator") is switched in lock-step with circulators of the triad circulator switch such that reflected RF power received at the shared load circulator is always directed to the high power load.

In either implementation, because shared high power load in method 300 is utilized to absorb reflected RF power for both output port of the triad ferrite circulator switch, the need for separate loads for absorbing reflected RF power for each of the outputs is avoided, saving space, weight and expense.

Figure 4:
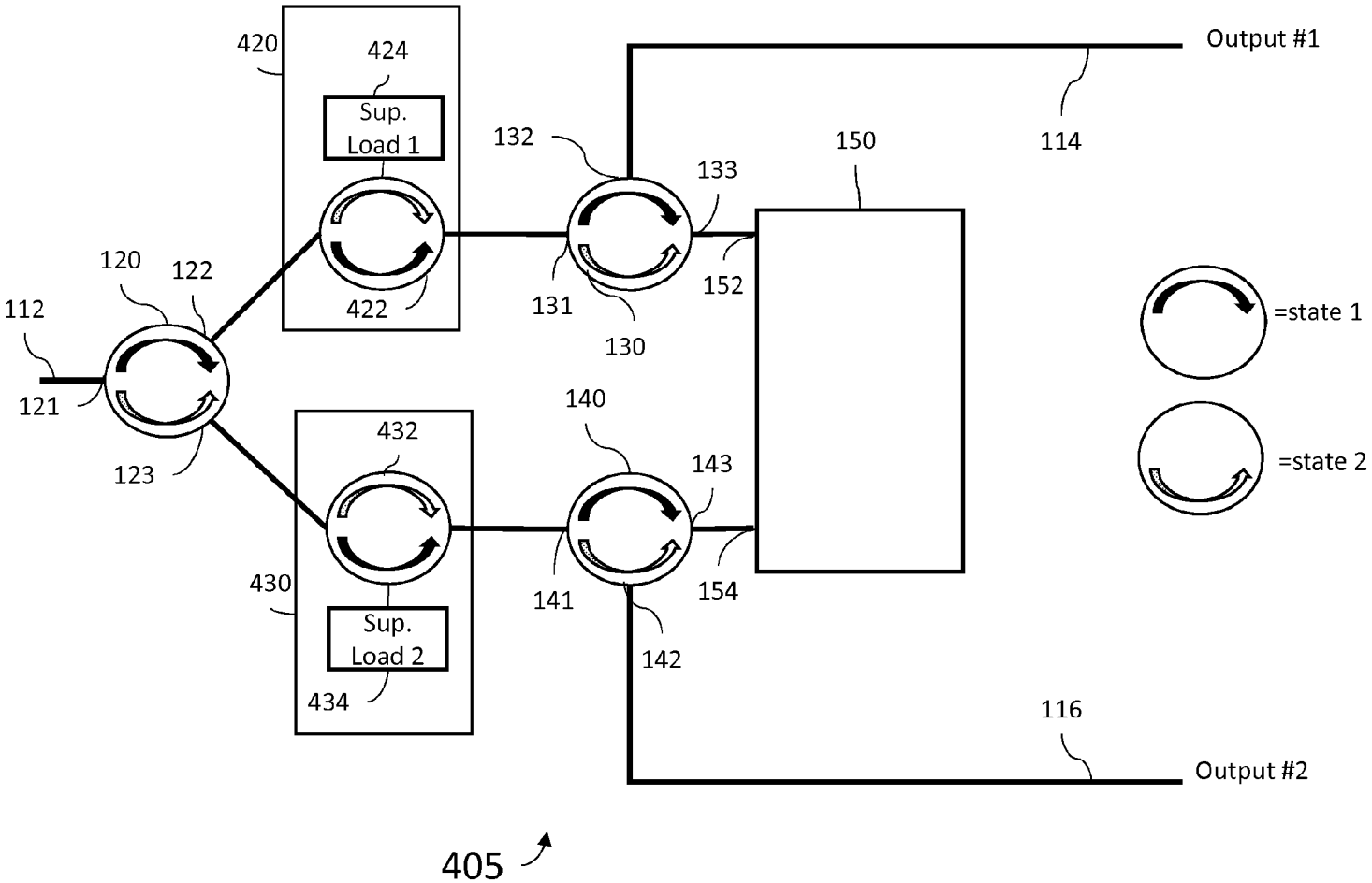
FIG. 4 is a block diagram illustrating a triad ferrite circulator switch of one embodiment of the present invention.

For any of the embodiments described herein, additional embodiments may include more triad switches that further comprise supplemental isolators intervening between the input coupled circulator (such as circulator 120) and the two output coupled circulators (such as circulators 130 and 140). FIG. 4 illustrates one such embodiment where a triad switch 405 comprises the same elements as triad switch 105, but further includes supplemental isolators 420 and 430. In the embodiment shown in FIG. 4, supplemental isolator 420 comprises a circulator 422 coupled to a first supplemental load 424 and is positioned between circulator 120 and circulator 130. Supplemental isolator 430 comprises a circulator 432 coupled to a second supplemental load 434 and is positioned between circulator 120 and circulator 140. With respect to supplemental isolator 420, in operation, RF power received from circulator 120 is directed through circulator 422 to circulator 130 and then to output 114. With respect to supplemental isolator 430, in operation, RF power received from circulator 120 is directed through circulator 432 to circulator 140 and then to output 116. As before, any reflected RF power received at either output 114 or 116 is directed to waveguide power divider 165 and waveguide loads 152 and 154. In the case where the primary loads 152 and 154 are unable to completely absorb the reflected RF power, the balance of that reflected RF power exits waveguide power divider 165 and is directed through circulators 130 and 140 to one or both of supplemental isolators 420 and 430. Reflected power received at supplemental isolators 420 and 430 is then directed (by circulators 422 and 432) to the supplemental waveguide loads 424 and 434 which will further attenuate the reflected RF power, thus providing additional isolation between output ports 114 and 116. In still other embodiments, additional supplemental isolators, such as 420 and 430, may similarly be coupled between the input coupled circulator 120 and the two output coupled circulators 130 and 140 to provide still further isolation.

Example Embodiments

Example 1 includes a high power circulator switch, the switch comprising: at least three ferrite circulators, the at least three ferrite circulators arranged as a triad switch, wherein a first circulator is coupled to a first output of the triad switch, a second circulator is coupled to a second output of the triad switch, and a third circulator is coupled to an input of the triad switch; and a shared high power load having a first port coupled to the first circulator and a second port coupled to the second circulator.

Example 2 includes the switch of example 1, wherein when the triad switch is switched to a first state, RF power received at the input is directed through the third circulator and the first circulator to the first output, and any reflected RF power received at the first output is directed by the first circulator to the first port of the shared high power load; and wherein when the triad switch is switched to a second state, RF power received at the input is directed through the third circulator and the second circulator to the second output, and any reflected RF power received at the second output is directed by the second circulator to the second port of the shared high power load.

Example 3 includes the switch of any of examples 1-2, wherein the shared high power load comprises a two port attenuating wave guide.

Example 4 includes the switch of example 3, wherein the two port attenuating wave guide is matched at the first port and second port to have a return loss of greater than 15 dB, and wherein the two port attenuating waveguide has a through loss between the first port and the second port of at least 15 dB.

Example 5 includes the switch of any of examples 3-4, wherein the two port attenuating wave guide comprises a tapered wedge design of absorbent material that substantially absorbs and spreads out the energy from reflected RF power along the length of the waveguide.

Example 6 includes the switch of any of examples 2-5, wherein the shared high power load comprises a fourth circulator coupled to a high power load; wherein the fourth circulator is configured to direct the reflected RF power to the high power load in a first direction around the fourth circulator when the triad switch is switched to the first state; and wherein the fourth circulator is configured to direct the reflected RF power to the high power load in a second direction around the fourth circulator when the triad switch is switched to the second state.

Example 7 includes the switch of any of examples 1-6, wherein the high power load comprises a wave guide matched to have a return loss of greater than 15 dB and provides an attenuation of the reflected RF power of at least 15 dB.

Example 8 includes the switch of any of examples 1-7, further comprising at least a first supplemental isolator intervening between the first circulator and the third circulator, and at least a second supplemental isolator intervening between the second circulator and the third circulator.

Example 9 includes the switch of any of examples 1-8, wherein the first circulator and the second circulator remain in a fixed switching state when a switching state of the third circulator is switched.

Example 10 includes the switch of any of examples 1-9, wherein the first circulator and the second circulator are switched between states in lock-step with switching of the third circulator.

Example 11 includes a method for switching RF power using a high power circulator switch, the method comprising: operating a triad ferrite circulator switch to direct RF power to either a first output port or a second output port; when the triad ferrite circulator switch is switched to a first state to direct RF power to the first output, directing any reflected RF power received at the first output through a first circulator of the triad ferrite circulator switch to a first port of a shared high power load; and when the triad ferrite circulator switch is switched to a second state to direct RF power to the second output, directing any reflected RF power received at the second output through a second circulator of the triad ferrite circulator switch to a second port of the shared high power load.

Example 12 includes the method of example 11, further comprising: absorbing the reflected RF power received at either the first port of the shared high power load or the second port of the shared high power load with the shared high power load.

Example 13 includes the method of any of examples 11-12, wherein the triad ferrite circulator switch further comprises a third circulator coupled to an input of the triad ferrite circulator switch, wherein the method further comprises: the third circulator directing RF power received at the input of the triad ferrite circulator switch to the first circulator when the switch is operating in the first state; and the third circulator directing RF power received at the input of the triad ferrite circulator switch to the second circulator when the switch is operating in the second state.

Example 14 includes the method of any of example 11-13, the shared high power load further comprising a two port attenuating wave guide.

Example 15 includes the method of example 14, wherein the two port attenuating wave guide is matched at the first port of the shared high power load and second port of the shared high power load to have a return loss of greater than 15 dB; and wherein the two port attenuating waveguide has a through loss between the first port of the shared high power load and the second port of the shared high power load of at least 15 dB.

Example 16 includes the method of any of examples 14-15, wherein the two port attenuating wave guide comprises a tapered wedge design of absorbent material that substantially absorbs and spreads out the energy from reflected RF power along the length of the waveguide.

Example 17 includes the method of any of examples 11-13, wherein the shared high power load comprises a fourth circulator coupled to a high power load; wherein the fourth circulator is configured to direct the reflected RF power to the high power load in a first direction around the fourth circulator when the triad switch is switched to the first state; and wherein the fourth circulator is configured to direct the reflected RF power to the high power load in a second direction around the fourth circulator when the triad switch is switched to the second state.

Example 18 includes the method of any of examples 13-17, wherein the triad ferrite circulator switch further comprises at least a first supplemental isolator intervening between the first circulator and the third circulator, and at least a second supplemental isolator intervening between the second circulator and the third circulator.

Example 19 includes the method of any of examples 13-17, wherein the first circulator and the second circulator remain in a fixed switching state when a switching state of the third circulator is switched.

Example 20 includes the method of any of examples 13-17, wherein the first circulator and the second circulator are switched between states in lock-step with switching of the third circulator.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

What is claimed is:

1. A high power circulator switch, the switch comprising:

at least three ferrite circulators, the at least three ferrite circulators arranged as a triad switch, wherein a first circulator is coupled to a first output of the triad switch, a second circulator is coupled to a second output of the triad switch, and a third circulator is coupled to an input of the triad switch; and a shared high power load having a first port coupled to the first circulator and a second port coupled to the second circulator.

2. The switch of claim 1, further comprising at least a first supplemental isolator intervening between the first circulator and the third circulator, and at least a second supplemental isolator intervening between the second circulator and the third circulator.

3. The switch of claim 1, wherein the first circulator and the second circulator remain in a fixed switching state when a switching state of the third circulator is switched.

4. The switch of claim 1, wherein the first circulator and the second circulator are switched between states in lock-step with switching of the third circulator.

5. The switch of claim 1, wherein when the triad switch is switched to a first state, RF power received at the input is directed through the third circulator and the first circulator to the first output, and any reflected RF power received at the first output is directed by the first circulator to the first port of the shared high power load; and wherein when the triad switch is switched to a second state, RF power received at the input is directed through the third circulator and the second circulator to the second output, and any reflected RF power received at the second output is directed by the second circulator to the second port of the shared high power load.

6. The switch of claim 5, wherein the shared high power load comprises a fourth circulator coupled to a high power load;

wherein the fourth circulator is configured to direct the reflected RF power to the high power load in a first direction around the fourth circulator when the triad switch is switched to the first state; and wherein the fourth circulator is configured to direct the reflected RF power to the high power load in a second direction around the fourth circulator when the triad switch is switched to the second state.

7. The switch of claim 6, wherein the high power load comprises a wave guide matched to have a return loss of greater than 15 dB and provides an attenuation of the reflected RF power of at least 15 dB.

8. The switch of claim 5, wherein the shared high power load comprises a two port attenuating wave guide.

9. The switch of claim 8, wherein the two port attenuating wave guide is matched at the first port and second port to have a return loss of greater than 15 dB, and wherein the two port attenuating waveguide has a through loss between the first port and the second port of at least 15 dB.

10. The switch of claim 8, wherein the two port attenuating wave guide comprises a tapered wedge design of absorbent material that substantially absorbs and spreads out the energy from reflected RF power along the length of the waveguide.

11. A method for switching RF power using a high power circulator switch, the method comprising:

operating a triad ferrite circulator switch to direct RF power to either a first output port or a second output port;

when the triad ferrite circulator switch is switched to a first state to direct RF power to the first output, directing any reflected RF power received at the first output through a first circulator of the triad ferrite circulator switch to a first port of a shared high power load; and when the triad ferrite circulator switch is switched to a second state to direct RF power to the second output, directing any reflected RF power received at the second output through a second circulator of the triad ferrite circulator switch to a second port of the shared high power load.

12. The method of claim 11, further comprising:

absorbing the reflected RF power received at either the first port of the shared high power load or the second port of the shared high power load with the shared high power load.

13. The method of claim 11, wherein the triad ferrite circulator switch further comprises a third circulator coupled to an input of the triad ferrite circulator switch, wherein the method further comprises:

the third circulator directing RF power received at the input of the triad ferrite circulator switch to the first circulator when the switch is operating in the first state; and the third circulator directing RF power received at the input of the triad ferrite circulator switch to the second circulator when the switch is operating in the second state.

14. The method of claim 13, wherein the shared high power load comprises a fourth circulator coupled to a high power load;

wherein the fourth circulator is configured to direct the reflected RF power to the high power load in a first direction around the fourth circulator when the triad switch is switched to the first state; and wherein the fourth circulator is configured to direct the reflected RF power to the high power load in a second direction around the fourth circulator when the triad switch is switched to the second state.

15. The method of claim 13, wherein the triad ferrite circulator switch further comprises at least a first supplemental isolator intervening between the first circulator and the third circulator, and at least a second supplemental isolator intervening between the second circulator and the third circulator.

16. The method of claim 13, wherein the first circulator and the second circulator remain in a fixed switching state when a switching state of the third circulator is switched.

17. The method of claim 13, wherein the first circulator and the second circulator are switched between states in lock-step with switching of the third circulator.

18. The method of claim 13, the shared high power load further comprising a two port attenuating wave guide.

19. The method of claim 18, wherein the two port attenuating wave guide is matched at the first port of the shared high power load and second port of the shared high power load to have a return loss of greater than 15 dB; and wherein the two port attenuating waveguide has a through loss between the first port of the shared high power load and the second port of the shared high power load of at least 15 dB.

20. The method of claim 18, wherein the two port attenuating wave guide comprises a tapered wedge design of absorbent material that substantially absorbs and spreads out the energy from reflected RF power along the length of the waveguide.

* * * * *